US005857637A

United States Patent [19]

Straaten et al.

[11] Patent Number: 5,857,637

[45] Date of Patent: Jan. 12, 1999

[54] CHEESE-PRODUCING TEXTILE MACHINE

[75] Inventors: Paul Straaten, Kerken; Ulrich Fechter, Mönchengladbach; Bernd Werner, Kamp-Lintfort, all of Germany

[73] Assignee: W. Schlafhorst AG & Co., Monchen-Gladbach, Germany

[21] Appl. No.: 985,107

[22] Filed: Dec. 4, 1997

[30] Foreign Application Priority Data

Dec. 7, 1996 [DE] Germany ..... 196 50 879.7

[51] Int. Cl.[6] ..... B65H 54/26; B65H 67/04; B65H 59/22

[52] U.S. Cl. ..... 242/473.7; 242/150 M; 242/475.7; 242/419.3

[58] Field of Search ..... 242/150 R, 150 M, 242/473.6, 473.7, 473.8, 475.7, 419.3, 419.4

[56] References Cited

U.S. PATENT DOCUMENTS

| | | | |
|---|---|---|---|
| 4,880,175 | 11/1989 | Yamauchi et al. | 242/150 M X |
| 5,299,750 | 4/1994 | Nakagawa et al. | 242/473.6 |
| 5,426,929 | 6/1995 | Schwalm et al. | 242/473.8 X |
| 5,582,354 | 12/1996 | Peters | 242/473.6 |

FOREIGN PATENT DOCUMENTS

| | | |
|---|---|---|
| 0 350 081 | 1/1990 | European Pat. Off. . |
| 38 12 449 | 11/1988 | Germany . |
| 39 02 182 | 8/1989 | Germany . |
| 41 30 301 | 3/1993 | Germany . |
| 39 04 065 | 4/1993 | Germany . |
| 42 21 504 | 2/1996 | Germany . |

*Primary Examiner*—Michael Mansen
*Attorney, Agent, or Firm*—Kennedy Covington Lobdell & Hickman, LLP

[57] ABSTRACT

A cheese-producing textile machine 1 has a plurality of winding stations 2 and a service unit 23 for servicing the winding stations 2. The textile machine 1 has a central control unit 37 as well as separate winding station computers 39 for the individual winding stations 2. The service unit 23 has a control computer 38 which is connected by a machine bus 40 with the central control unit 37 as well as with the winding station computers 39. During the process of exchanging a cheese with an empty bobbin performed by the service unit 23, the yarn tensioner 14 of the respective winding station 2 is actuated via the machine bus 40 in accordance with the control computer 38 of the service unit 23, to set the tension of the yarn 30 optimally according to the respectively existing processing conditions.

5 Claims, 3 Drawing Sheets

CHEESE-PRODUCING TEXTILE MACHINE

FIELD OF THE INVENTION

The present invention relates to a cheese-producing textile machine having a plurality of winding stations, each of which has a yarn tensioner a winding station computer for controlling the operation of the respective winding station, and a service unit having its own control computer which can be connected with the winding station computers for the transmission of control commands.

BACKGROUND OF THE INVENTION

German Patent Publication DE 39 04 065 C2 describes an automatic cheese winder having a plurality of winding stations each of which has a device for regulating the yarn tension during the winding process. These known installations have a device for detecting the rotational speed (rpm) of the cheese, a device for calculating the instantaneous diameter of the cheese, and a memory device with a preset yarn tension program. In installations of this type, the yarn tensioner is controlled during the course of the bobbin winding operation to gradually reduce the yarn tension as the diameter of the cheese increases.

Furthermore, another cheese winder is known from European Patent Publication EP 0 350 081 A1, wherein the winding speed of the winding units is controlled as a function of the remaining yarn length of the supply bobbins. Each of these winding units also has a yarn tensioner which can be actuated in a defined manner, if required, by the winding station computer during the winding process.

Yarn tensioners have been known for a long time in connection with automatic: cheese winders and basically have a rotatably disposed brake pad arrangement wherein a brake pad can be axially acted upon by means of a moving coil. For example, German Patent Publication DE 41 30 301 A1 describes such a yarn tensioner, which has been proven effective in actual use.

An automatic cheese winder with a plurality of winding stations, each of which has a separate winding station computer connected to a central control unit of the textile machine, is known from German Patent Publication DE 39 02 182 A1. In addition, a service unit for the winding stations is connected with this central control unit of the textile machine. The service unit can actuate the winding drive of each winding station via the central control unit and the winding station computers such that, during the process of changing from a cheese to an empty bobbin the yarn guide drum rotates at a circumferential speed which is reduced in respect to the "normal" winding process.

German Patent Publication DE 42 21 504 A1 describes an automatic cheese winder, whose work positions are connected by means of a bus with a service vehicle. If a need for service arises at one of the work stations, the respective work station issues an optical signal which is detected by the service vehicle patrolling in front of the work stations and is acknowledged by it by means of a light signal after it has been positioned at this work station. The respective work station is activated by this light signal so that it is subsequently possible to issue work commands from the service vehicle via the bus to the respective work station, such as, for example, for the rewinding of the drive roller, blowing the work station clean, or the like.

OBJECT AND SUMMARY OF THE INVENTION

Based on the above mentioned prior art, it is an object of the present invention to improve the customary procedure in automatic cheese winders for changing from a cheese to an empty bobbin.

This object is attained in accordance with the present invention by means of a cheese-producing textile machine which basically comprises a plurality of winding stations, each having a respective yarn tensioner and a respective winding station computer for controlling the yarn tensioner, and a service unit for traveling among the winding stations to perform servicing operations thereat. In accordance with the present invention, the service unit has its own respective control computer for connection with each respective winding station computer for transmission of control commands to the yarn tensioner of the respective winding station being serviced by the service unit.

This fundamental concept of the present invention provides the particular advantage of making it possible to adapt the setting of the yarn tensioner, which is normally actuated by the winding station computer, during the winding process as well as during the changing process from a cheese to an empty bobbin in a manner adapted to the respective prevailing requirements of the winding operation.

In particular, during the bobbin manipulating steps which must be performed in connection with the changing process from a cheese to an empty bobbin, the required yarn tension can be optimally adapted by means of the yarn tensioner arranged at the winding station in accordance with parameters provided by the control computer of the service unit. In the process, it is possible during the bobbin changing operation to select smaller settings than those customary during the winding process.

Since the control computer of the service unit can exactly actuate the yarn tensioner of the winding station via a machine bus, it is not necessary for the service unit to have its own yarn tensioning device in order to be able to maintain an exact yarn tension during the changing process.

In an advantageous embodiment of the invention, the yarn tensioning values, which can be preset by the control computer of the service unit and must be applied to the yarn by means of the yarn tensioner, can be individually matched to the respective bobbin manipulating measures of the service unit. Accordingly, the yarn tension is automatically set optimally even during the changing process and, for example, is a function of whether the cheese is to be given either a yarn reserve in the form of a chord-like yarn segment extending over the front of the cheese, or a tip reserve winding in the form of a so-called top cone winding applied to the bobbin tube tip. A special optimal yarn tension is also set when providing a bottom reserve winding on the empty bobbin.

The required parameters for setting the yarn tensioner can in this case be preset by the control computer of the service unit either in absolute values, or as a percentage deviation from adjustable set values.

Presetting of such parameters as a percentage deviation from set values is in this case particularly advantageous, since it is thereby possible to match the setting of the yarn tensioner in respect to the yarn then being processed, for example with regard to the breaking resistance, even during the winding process.

Further details, features and advantages of the present invention will be explained and understood from an exemplary embodiment, which will be described below with reference to the accompanying drawings.

DETAILED DESCRIPTION OF THE PREFERRED EMBODIMENT

Figure 1:
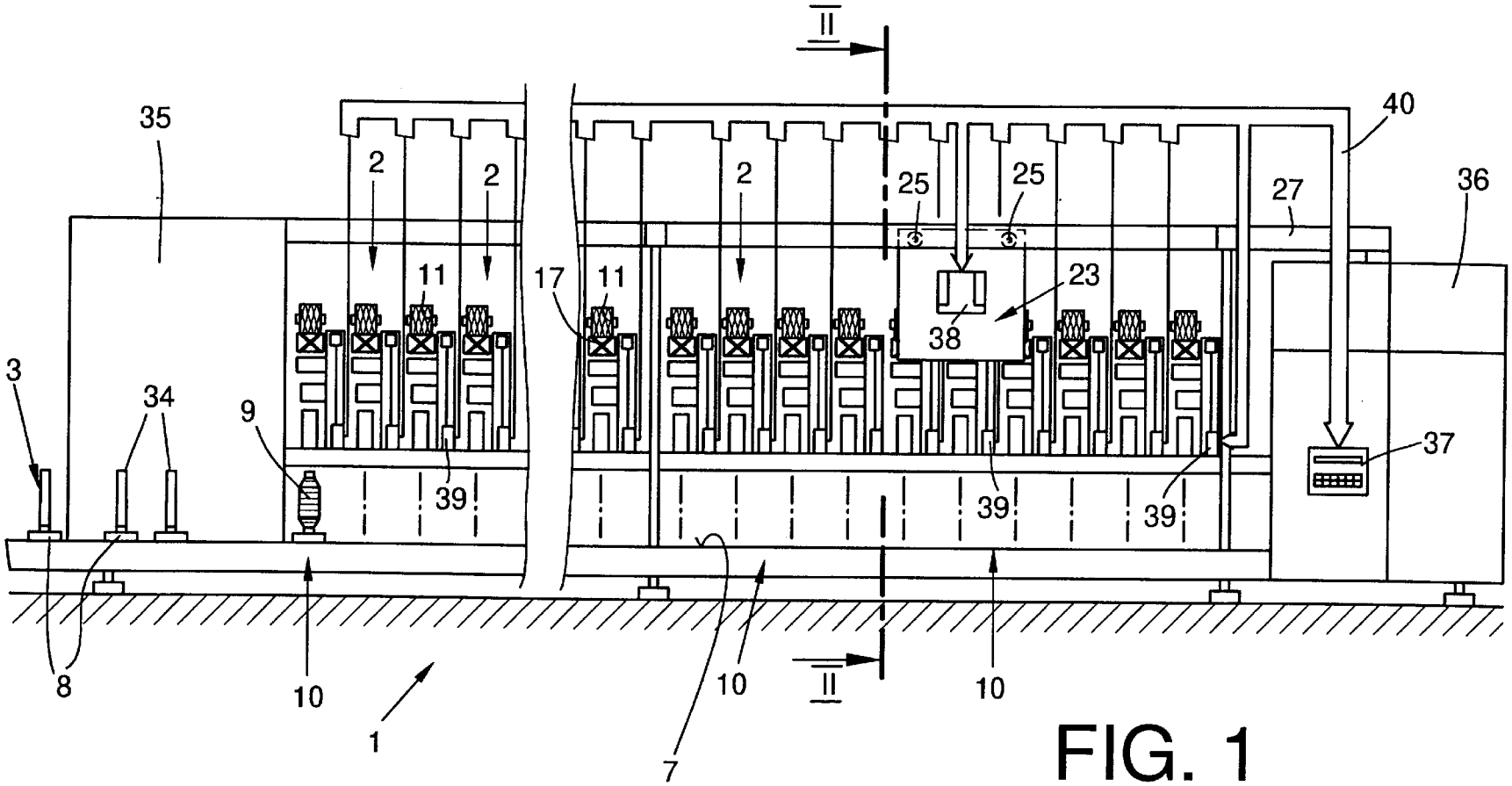
FIG. 1 is a front elevational view of a cheese-producing textile machine with a service unit which is connected via a machine bus with the winding station computers of the winding stations, in accordance with the present invention.

A cheese-producing textile machine, preferably an automatic cheese winder in the exemplary embodiment, is schematically represented in FIG. 1 and identified as a whole by the reference numeral 1. Typically, such automatic cheese winders have a plurality of identical work stations (in the present case winding stations 2) aligned between end frames 35, 36, of the machine. Spinning cops 9, produced on a ring spinning machine (not represented), are rewound in these winding stations 2 into larger volume cheeses 11 in a known manner which therefore is not explained in detail.

The finished cheeses 11 are rolled laterally onto a cheese transport device 21 by means of an automatically operable traveling service unit, for example by means of a cheese changer 23, and are subsequently transported to a bobbin loading station (not represented) or the like arranged at the end of the machine.

In addition, such automatic cheese winders 1 often have a logistical system in the form of a cop/empty bobbin transport system 3. Spinning cops 9 and unwound empty bobbins 34 are circulated on transport plates 8 transported by this transport system 3.

Such automatic cheese winders 1 additionally have a central control unit 37, which is connected via a machine bus 40 with separate respective winding station computers 39 of the individual winding stations 2 as well as with a control computer 38 of the service unit 23 servicing the winding stations 2.

Figure 2:
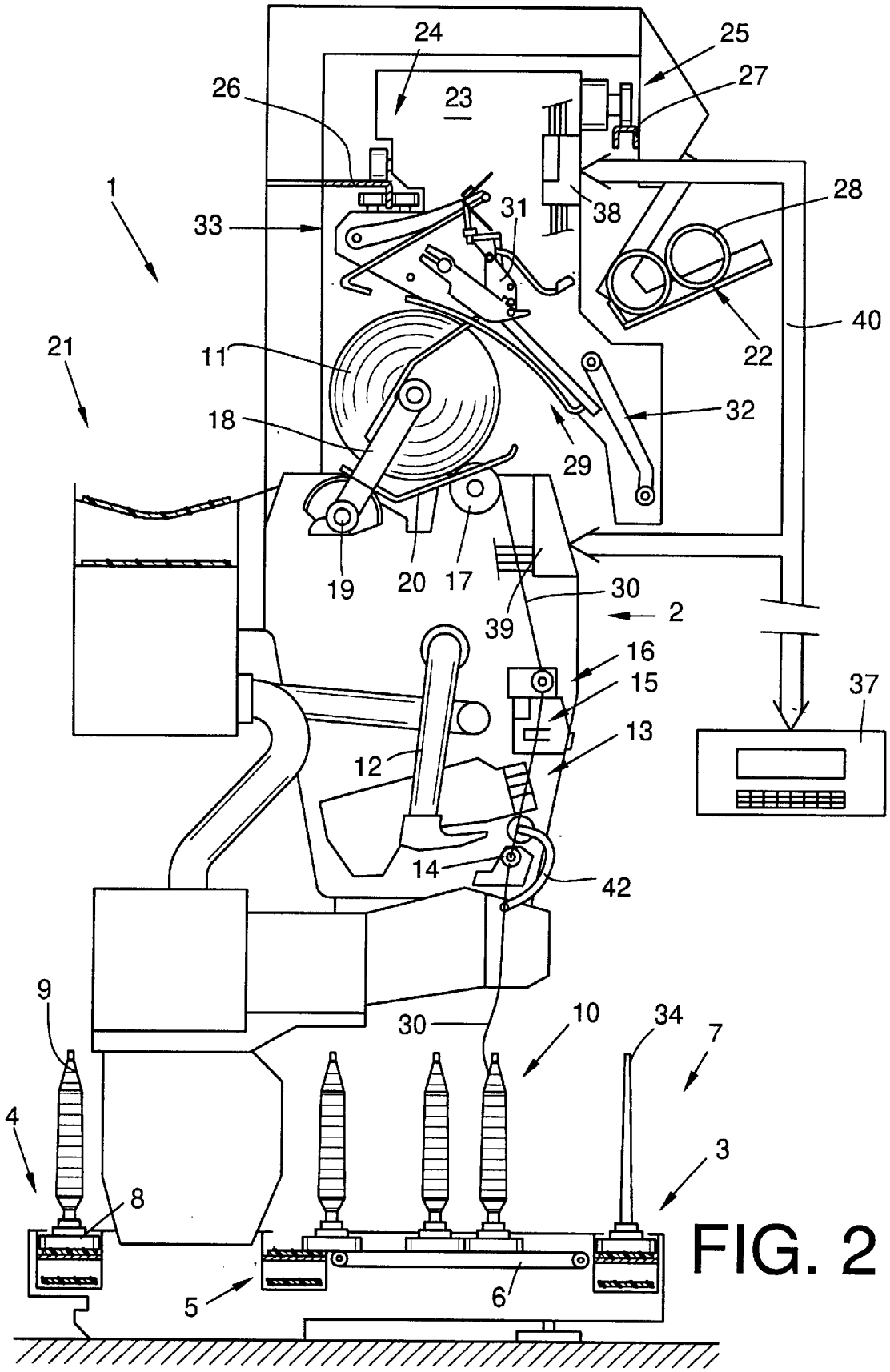
FIG. 2 is a side elevational view of a winding station of the automatic cheese winder of FIG. 1, showing a yarn tensioner which can be actuated via the machine bus by the control computer of the service unit.

As can be seen in FIG. 2 in particular, the service unit 23 is displaceably supported by means of running gear 24, 25 on tracks 26, 27 extending the length of the machine above the winding stations 2.

The service unit 23 not only serves to transfer the cheeses 11 finished in the winding stations onto the laterally adjacent cheese transport device 21, but also automatically places an empty bobbin 28 into the winding creel of the respective winding station 2 after removal of a finished cheese to facilitate winding of a new cheese. In the process, the service unit 23 preferably takes the empty bobbin 28 out of an empty bobbin magazine 22, which is part of the winding station.

The cop and empty bobbin transport system 3 as a whole is relatively extensive and known per se, and hence FIG. 2 representatively depicts only a bobbin supply track 4 which extends over the length of the machine, a reversing track 5 which similarly extends behind the winding stations 2, one of a plurality of transverse transport tracks 6 leading to the respective winding stations 2 and an empty bobbin return track 7.

The spinning cops 9 are transported via the supply track 4 onto the reversing track 5 and distributed therefrom onto the plural transverse tracks 6, on each of which the cops 9 are delivered to an unwinding position 10 located therealong at the respective winding station 2, from which the cops are rewound by the respective winding station 2 into large volume cheeses 11.

As already known but only partially and schematically indicated in the drawings, the individual winding stations have various devices which assure an orderly operation of these work stations. In FIG. 2, the yarn traveling from the spinning cop 9 to the cheese 11 is identified by 30, a suction nozzle is identified by 12 and a gripper tube is identified by 42. A splicing device is identified by the reference numeral 13 and a yarn tensioning device is identified by the reference numeral 14. In addition, such winding stations have a yarn cleaner 15 with a yarn cutting device and a yarn waxing device 16.

A drive drum 17 peripherally drives the cheese 11 during the winding process by frictional surface contact. During the winding process the cheese 11 is held in a winding creel 18, which is pivotably seated on a shaft 19. A swivel plate 20 is arranged below the winding creel 18 for limited pivotability, whereby the finished cheeses can be transferred by pivoting of the plate 20 to the cheese transport device 21 located laterally adjacent and behind the winding stations 2.

As already indicated above, the winding stations 2 are serviced by means of a service unit, in this case a so-called cheese changer 23. Specifically, the cheese changer 23 functions to transfer onto the cheese transport device 21 full cheeses 11 which have attained a predetermined diameter and to subsequently replace the removed cheese in the winding creel 18 with an empty bobbin 28 from the empty bobbin magazine 22.

Some of the manipulating elements of the service unit 23 needed in the course of the process of exchanging a cheese with an empty bobbin are represented in FIG. 2: a creel opener 29, a creel lifter 32, a bobbin guide device 33 and an empty bobbin feeder 31. For the sake of clarity, the representation of further manipulating elements of such cheese changers has been omitted in this drawing figure. The devices for preparing a tip reserve winding and the bottom reserve winding, for example, are not shown.

Figure 3:
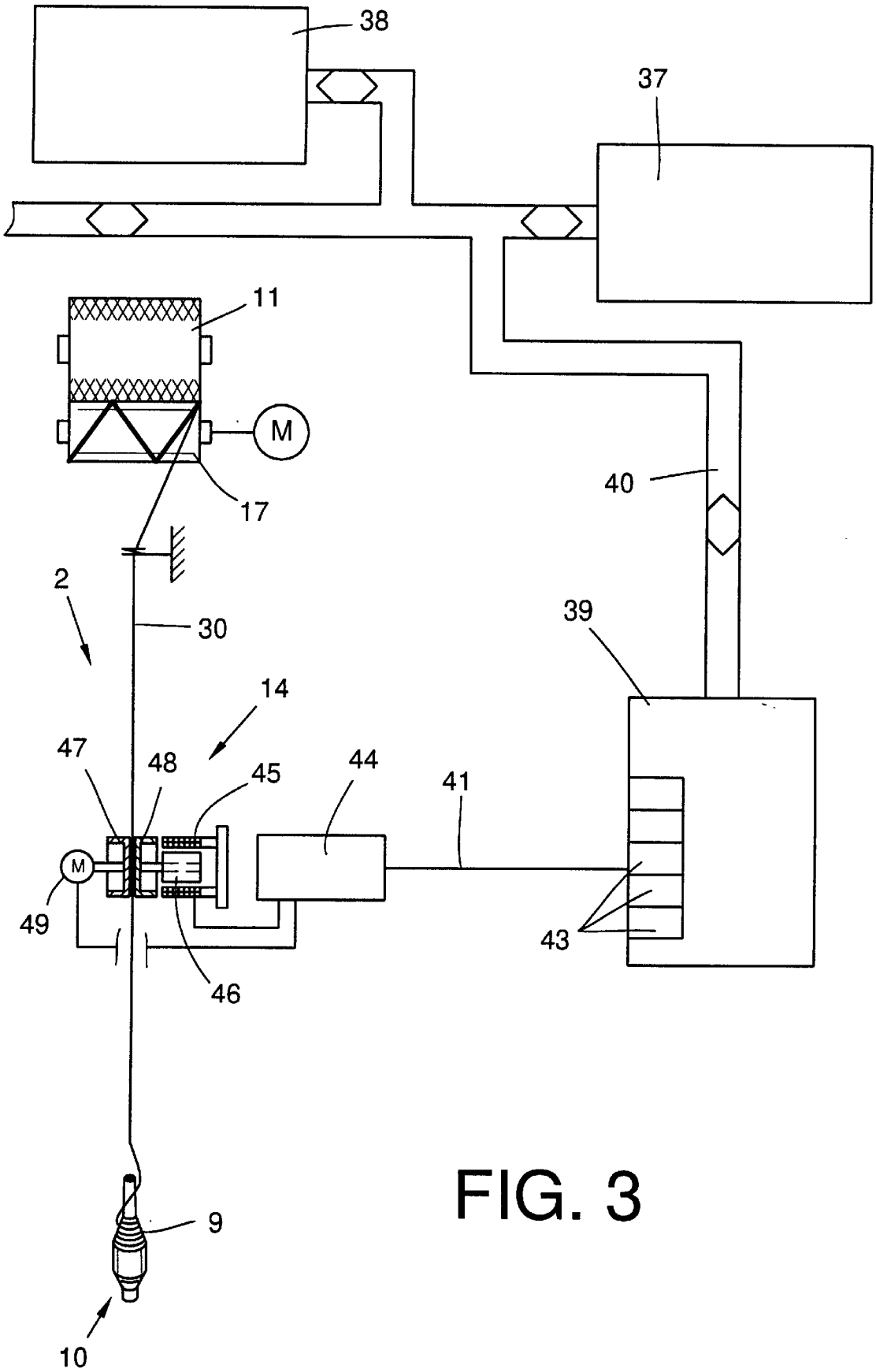
FIG. 3 is a schematic diagram representing the winding station of FIG. 2 and the means of actuation of the yarn tensioner of the station by the control computer of the service unit.

As indicated in FIGS. 1 to 3, the central control unit 37 of the textile machine 1, the winding station computers 39 of the individual winding stations 2 and the control computer 38 of the service unit 23 are connected with each other by means of the machine bus, represented only schematically at 40.

FIG. 3 shows that the winding station computer 39 has several so-called drivers 43, which are connected via command lines with the subordinated functional elements. For example, the end stage 44 of the yarn tensioner 14 is connected via a command line 41 to one of the drivers 43 of the winding station computer 39.

The yarn tensioner 14 has a revolving plate arrangement 47, 48, which is known per se. In this case, the revolving plate 47 can be acted upon in a rotating manner by means of a drive 49, while the revolving plate 48 can be axially displaced by a moving coil 45, 46. The yarn 30 withdrawn from a spinning cop 9 to be delivered to and subsequently wound into a cheese 11, is positively engaged between the revolving plates 47, 48 to apply a tensioning to the yarn 30 which can be adjusted by the measure of the clamping action of the plates 47, 48 of the yarn tensioner, which thereby act as brake pads. In particular, with these known yarn tensioners, the yarn tension is typically adjusted by an appropriate current supply to the moving coil 45, 46.

The functioning of the device may thus be understood. During the "normal" winding process the yarn tension imposed on the yarn 30 is regulated by means of the yarn tensioner 14, which at such time is appropriately actuated by the winding station computer 39 of the respective winding station.

When a cheese 11 has reached its predetermined diameter or its predetermined yarn length at one of the winding stations 2 of the automatic cheese winder 1, the yarn 30 is first cut by means of the yarn cutting device 15, and the cheese is lifted off the drive drum by a cheese lifting device (not represented). The cheese 11 is then no longer driven and thereby slows to a stop, either by braking or not.

Since the service unit 23 can only grasp a running yarn 30, the cheese is subsequently again lowered onto the drive drum 17, which has also been stopped in the interim, and the yarn 30 is freshly spliced in the splicing device 13 of the winding station 2.

At the same time the cheese changer 23 is signaled by the respective winding station computer 39 to travel to the stopped winding station. The request for the cheese changer can also be performed anticipatively, i.e., the request signal can already have been issued prior to the cheese attaining its final diameter.

The requested service unit 23 is positioned at the respective winding station and first picks up the yarn 30 by means of a so-called yarn lifter in order to have it ready for the subsequent changing process. Furthermore, at this time and for the length of the changing process, the control computer 38 of the service unit 23 takes over the control of the winding station computer 39 of the respective winding station 2 via the machine bus 40. Specifically, during the changing process the control and actuation of the yarn tensioner 14 takes place via the control computer 38 of the service unit 23. The yarn tension values which are maintained during the changing process by the yarn tensioner 14 in this case are a function of the respective bobbin manipulating measures or of the selected embodiment of the cheese 11. If, for example, the cheese 11 has been provided with a top cone winding, the yarn 30 held in the yarn lifter must be wound at a different yarn tension on the bobbin tip than if the cheese were to contain a yarn reserve in the form of a chord-like yarn segment.

To form a top cone winding, the yarn 30 held in the yarn lifter is displaced, for example, in the direction of the bobbin tip by an appropriate work element (not represented), and in the process the cheese is slowly turned in the winding direction. In this case the yarn tension is preferably slightly higher than the yarn tension during the last part of the yarn travel.

If the yarn end of a cheese 11 is to be provided in the form of a chord-like yarn segment, the yarn is briefly moved off the surface of the cheese following the bobbin travel and immediately returned to the surface. In this case it is advantageous if work is performed with a clearly reduced yarn tension. The method for preparing such a yarn chord is basically known and described, for example, in German Patent Publication DE 40 40 552 C2.

After the desired reserve winding has been applied, the yarn 30 is cut, with the lower yarn end from the feed cop remaining fixed in a clamping device of the yarn lifter. Subsequently, the winding creel 18 is acted upon by means of the creel opener 29 of the service unit 23, so that the cheese 11 is deposited on the swivel plate 20. Then the swivel plate 20 is lifted by the creel lifter 32 so that the cheese 11 rolls onto the cheese transport device 21. In the process the cheese is guided by a bobbin guide device 33.

In the next step, an empty bobbin 28 is taken by the bobbin feeder 31 out of the empty bobbin magazine 22 (which is part of the winding station) and is positioned between the opened arms of the winding creel 18. At the same time, the lower yarn end held in the yarn lifter is positioned between the front of the empty bobbin and the empty bobbin receiver of the winding creel 18 in such a way that it is clamped when the creel is closed. Thereafter, the service unit 23 forms the empty bobbin 28 with a bottom reserve winding in a usual manner by means of a known device (not represented). The control computer 38 of the service unit 23 continues to control the actuation of the yarn tensioner 14 during the preparation of this bottom reserve winding, and in this case insures that the yarn 30 is wound on the empty bobbin 28 with a yarn tension which is slightly increased in comparison with the normal winding tension. The winding station computer 39 of the winding station 2 resumes the actuation of the yarn tensioner 14 only when the regular winding operation is started again, i.e. when the service unit 23 leaves the winding station.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A cheese-producing textile machine comprising a plurality of winding stations, each having a respective yarn tensioner and a respective winding station computer for controlling the yarn tensioner, and a service unit for travelling among the winding stations to perform servicing operations thereat, the service unit having a control computer for connection with each respective winding station computer for transmission of control commands to the yarn tensioner of the respective winding station being serviced by the service unit.

2. A cheese-producing textile machine in accordance with claim 1, and further comprising a machine bus for connecting the control computer of the service unit with the winding station computers of the winding stations.

3. A cheese-producing textile machine in accordance with claim 2, wherein the service unit comprises means for performing an exchange of a finished cheese with an empty bobbin, the control computer of the service unit being adapted to control the yarn tensioner to maintain a predetermined yarn tension value in the yarn of the cheese during the exchange.

4. A cheese-producing textile machine in accordance with claim 3, wherein the control computer of the service unit stores preset absolute values as parameters for controlling the yarn tensioners of the respective winding stations.

5. A cheese-producing textile machine in accordance with claim 3, wherein the control computer of the service unit is programmed to control the yarn tensioner according to a predetermined percentage deviation from set values.

* * * * *